US011825946B1

(12) United States Patent
Anderson et al.

(10) Patent No.: US 11,825,946 B1
(45) Date of Patent: Nov. 28, 2023

(54) MODULAR FLOATING SHELF SYSTEM

(71) Applicant: Silicate Studio Home, LLC, Rexburg, ID (US)

(72) Inventors: Kevin Anderson, Rexburg, ID (US); Jeff Ward, Rexburg, ID (US); Riley Plocher, Rexburg, ID (US)

(73) Assignee: Silicate Studio Home, LLC, Rexburg, ID (US)

( * ) Notice: Subject to any disclaimer, the term of this patent is extended or adjusted under 35 U.S.C. 154(b) by 0 days.

(21) Appl. No.: 17/824,234

(22) Filed: May 25, 2022

(51) Int. Cl.
*A47B 96/02* (2006.01)
*A47B 96/06* (2006.01)

(52) U.S. Cl.
CPC ..... *A47B 96/028* (2013.01); *A47B 96/061* (2013.01); *A47B 96/067* (2013.01)

(58) Field of Classification Search
CPC ... A47B 96/028; A47B 96/061; A47B 96/067; A47B 87/002
See application file for complete search history.

(56) References Cited

U.S. PATENT DOCUMENTS 1,240,863 A 9/1917 Lyda
3,333,555 A 8/1967 Kapnek
3,565,020 A 2/1971 Schier et al.
3,752,088 A 8/1973 Kapnek
3,837,605 A 9/1974 Sicard
3,895,413 A 7/1975 Buergers
5,265,971 A 11/1993 Duc
5,813,550 A * 9/1998 Sheehan ..... A47F 5/0807 248/220.31
5,845,453 A 12/1998 Goya
5,954,306 A 9/1999 Hoover
6,164,610 A 12/2000 Santiago
6,182,937 B1 2/2001 Sanderse
6,268,574 B1 7/2001 Edens
6,467,636 B1 10/2002 Schaefer
6,848,659 B1 2/2005 Liu
8,082,859 B2 12/2011 Sevack
8,602,372 B2 12/2013 Yu
8,689,519 B2 4/2014 Zelich
(Continued)

OTHER PUBLICATIONS

Lumberjocks, "Supporting floating shelves," http://web.archive.org/web/20150527104027/http://lumberjocks.com/topics/58185 Believed to be publically available as of May 27, 2015. 4 pgs.
(Continued)

*Primary Examiner* — Matthew W Ing
(74) *Attorney, Agent, or Firm* — Thorpe North & Western, LLP

(57) ABSTRACT

A modular floating shelf system comprises a modular floating shelf bracket mounting a shelf to a wall and with the modular floating shelf bracket being contained in and hidden by the shelf. The modular floating shelf bracket comprises at least two bracket modules, including a main bracket and an extension bracket, selectively coupleable together. A coupler plate is coupled to a proximal end of an extension mounting plate and overhangs a seam between the extension mounting plate and a main mounting plate. A bore extends through the overhang of the coupler plate and receives a cantilevered main beams of the main bracket. The main and extension brackets can be selectively coupled together to accommodate wider shelves.

20 Claims, 8 Drawing Sheets

(56) References Cited

U.S. PATENT DOCUMENTS

| | | | | |
|---|---|---|---|---|
| 9,185,979 | B1 | 11/2015 | Jenks et al. | |
| 9,861,198 | B2 | 1/2018 | Anderson | |
| 11,013,326 | B2 | 5/2021 | Graber et al. | |
| 2002/0104946 | A1 | 8/2002 | Lai | |
| 2005/0127017 | A1 | 6/2005 | Kessel et al. | |
| 2008/0121146 | A1 | 5/2008 | Burns et al. | |
| 2009/0224119 | A1* | 9/2009 | Heffernan | A47B 96/066 248/220.21 |
| 2011/0147551 | A1* | 6/2011 | Richard | A47B 96/067 29/428 |
| 2013/0048584 | A1 | 2/2013 | Kaperst | |
| 2013/0081249 | A1* | 4/2013 | McLean | B25H 3/04 211/175 |
| 2014/0217252 | A1 | 8/2014 | Fitzgerald et al. | |
| 2021/0071699 | A1 | 3/2021 | Bastian et al. | |

OTHER PUBLICATIONS

Lumberjocks, "Supporting floating shelves," http://web.archive.org/web/20150321053613/http"//lumberjocks.com:80/topics/47100 Believed to be publically available as of Mar. 21, 2015. 8 pgs.

The Shelving Shop, "Floating shelf bracket," http://www.shelvingshop.com.au:80/shopexd.asp?id=832 Believed to be publically available as of Nov. 30, 2012. 3 pgs.

Silicatestudio,"Brad's Bomb-diggity Custom Brackets," https://www.etsy.com/listing/222309673/brads-bomb-diggity-custom-brackets Believed to be publically available as of Feb. 11, 2015. 5 pgs.

Silicatestudio,"Brad's Bomb-diggity Custom Brackets," https://www.etsy.com/shop/SilicateStudio/reviews?ref=pagination&page=34 Believed to be publically available as of Feb. 17, 2015. 4 pgs.

* cited by examiner

MODULAR FLOATING SHELF SYSTEM

BACKGROUND

Shelves can be attached to walls using various support brackets. Some support brackets for wall-mounted shelves are able to support more weight than others. Brackets that are able to support more weight tend to be bulkier and more visible than brackets that support less weight. A consumer may find a highly visible support bracket on a wall to be undesirable in a room where the consumer wishes to establish a certain decor. Shelves can be provided or desired in various different widths. The development of shelving solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
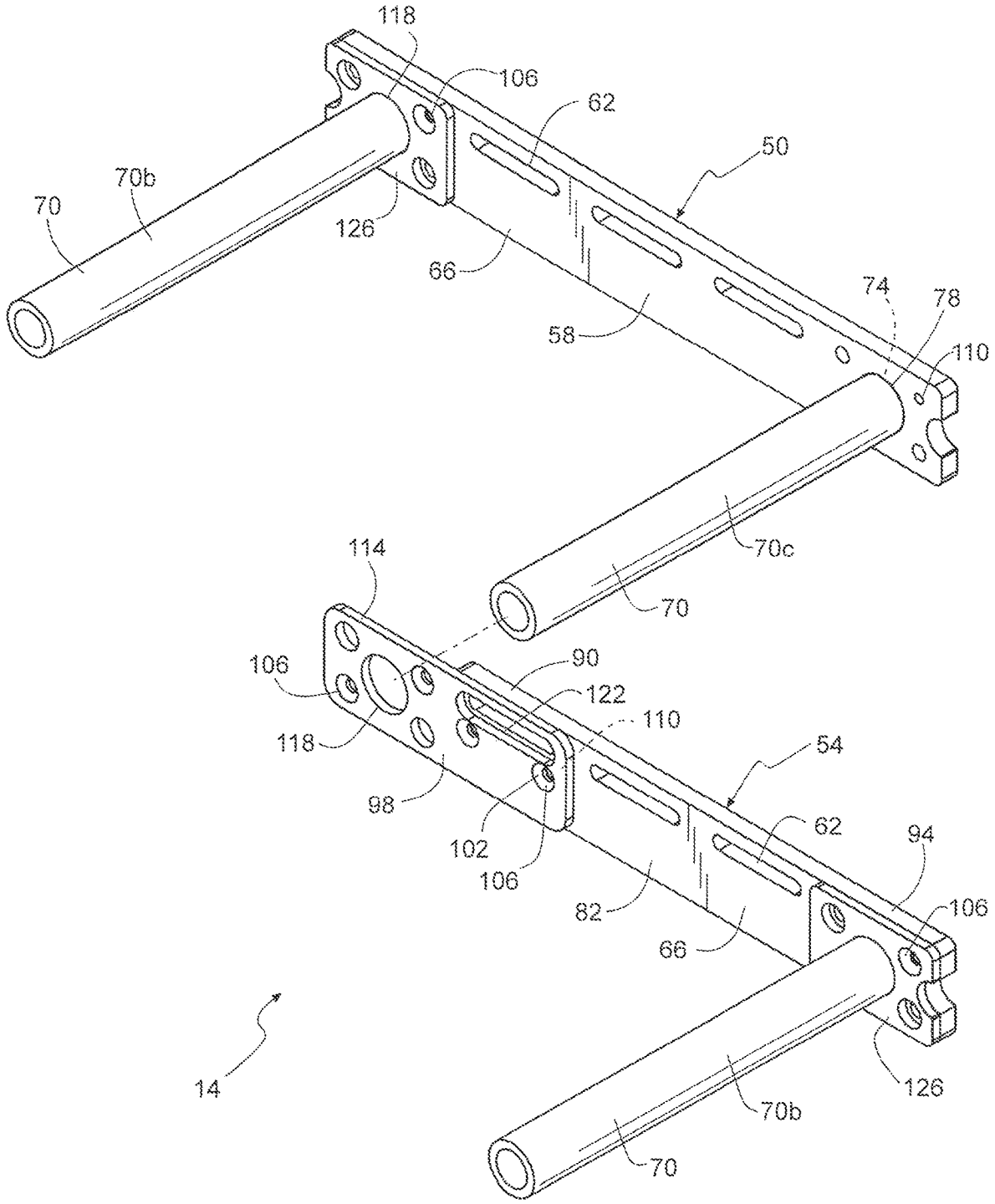
FIG. 1 is an exploded perspective view of a modular floating shelf bracket in accordance with an embodiment of the invention, shown with a 20-inch beam-to-beam spacing.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present application provides various examples of a modular floating shelf bracket and a modular floating shelf system for mounting a shelf to a flat vertical surface, such as a wall. Examples and configurations disclosed herein provide modular bracket pairs that can be selectively coupled together to accommodate a wider shelf. Thus, the modular bracket can be used for either a narrower shelf, or a wider shelf. In another aspect, the brackets that have a high ratio of weight-supporting capacity to visibility relative to previous wall-mountable shelf-support apparatuses.

When decorating a room, a consumer may wish to a mount shelf to one or more walls in order to provide increased space for display, storage and/or work. Some wall-mountable shelf-support brackets are commercially available. Many such brackets are mounted below the shelves they support and therefore remain visible beneath the shelves after installation is complete. Other varieties of shelf-support brackets are mounted above the shelves they support, but likewise remain visible after installation is complete.

Some consumers may wish to mount a shelf to a wall but may not wish for the bracket that supports the shelf or desk to be conspicuously visible. A shelf that is supported by a bracket that is not conspicuously visible is sometimes referred to as a floating shelf, since the shelf may appear to float due to the low visibility of the supporting bracket.

With some brackets, the bracket is sized for a particular shelf or width of a shelf. Thus, numerous different sized brackets are often provided to accommodate the different sized shelves.

The modular brackets and system designed in accordance with the design principles described in the present disclosure provide modular brackets that can be used alone for a narrower shelf, or combined together for a wider shelf. In one aspect, the bracket modules can be provided in pairs with a beam-to-beam spacing, such as 20, 16, 12 and/or 8 inches. Thus, fewer bracket widths are required, reducing production and storage costs. In another aspect, one bracket module can have a bore that received the beam of another bracket module. Thus, the bracket modules can be easily aligned. In another aspect, a coupler plate can couple both brackets together, and can span a seam between the brackets, to provide a secure bracket.

In addition, with some brackets there is often a tradeoff between visibility and weight-supporting strength because a bracket that is less conspicuous tends to be smaller and tends to absorb the stress of weight borne by a shelf over a smaller area. Consequently, consumers who wish to store or display relatively heavy items on floating shelves, or utilize a floating desk, may have difficulty finding brackets that provide both a desired high level of weight-bearing capacity and a desired low level of bracket visibility.

Brackets designed in accordance with the design principles described in the present disclosure provide a high ratio of weight-supporting capacity to visibility relative to existing commercial support brackets for floating shelves. In one example, brackets are contained in and hidden by the shelf. Thus, the bracket is hidden, and the shelf appears to float with respect to the wall.

Figure 2:
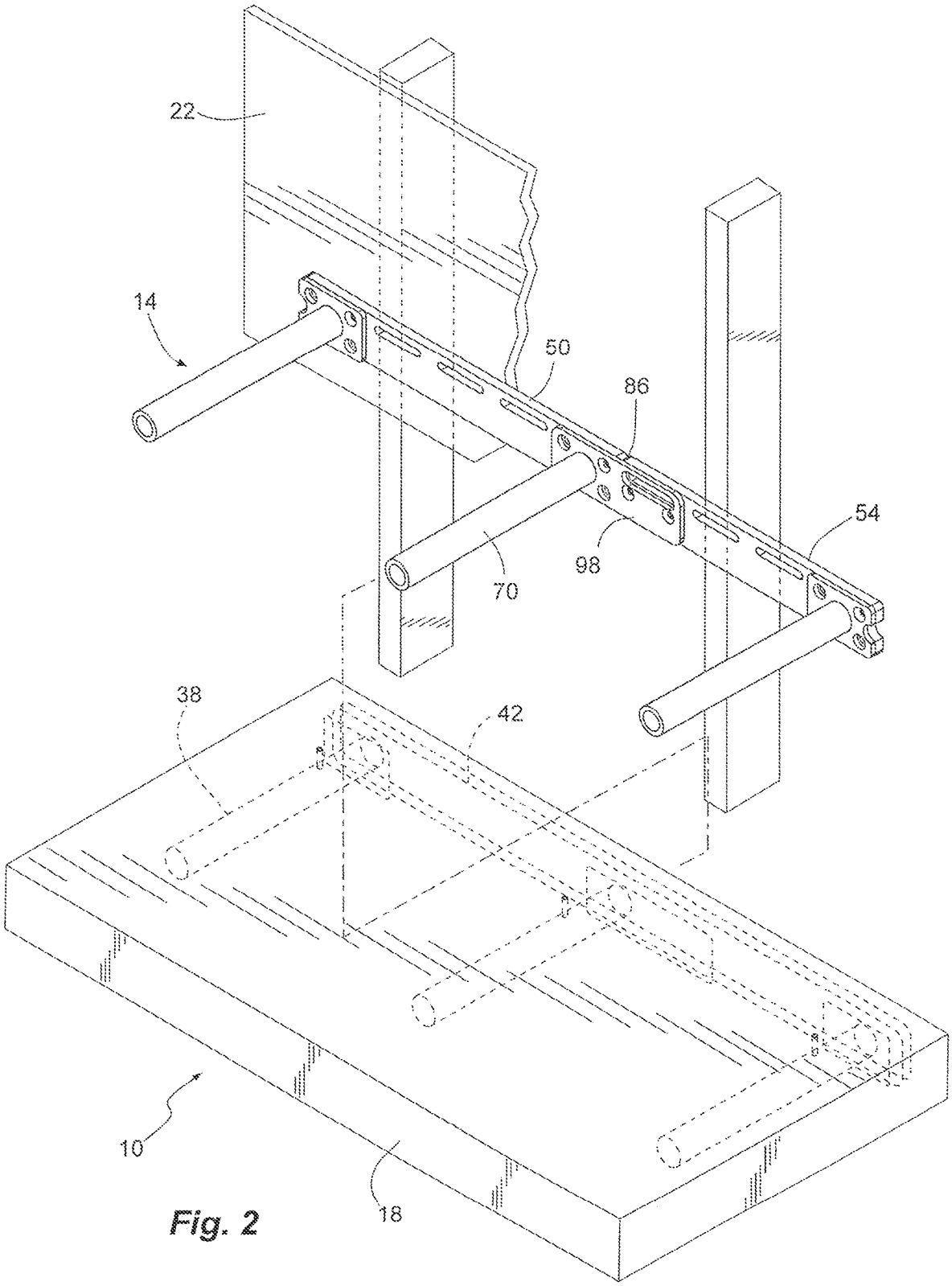
FIG. 2 is a partial perspective schematic view of a modular floating shelf system in accordance with an embodiment of the invention with the modular bracket of FIG. 1 shown mounted to a wall to support a shelf.
Figure 3:
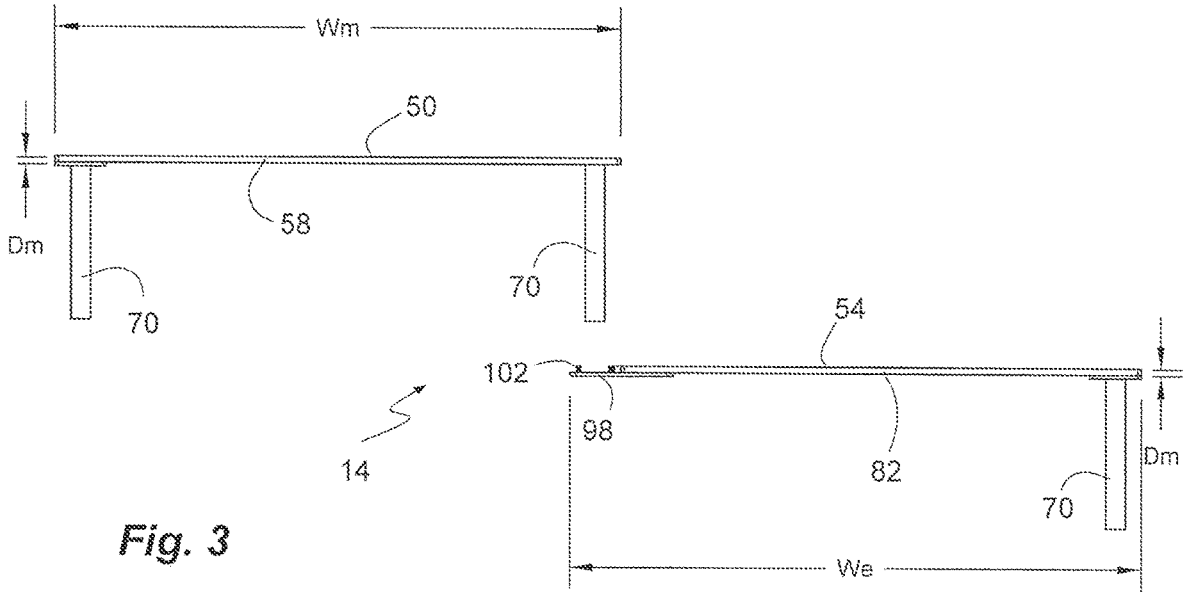
FIG. 3 is an exploded top view of the modular bracket of FIG. 1.
Figure 4:
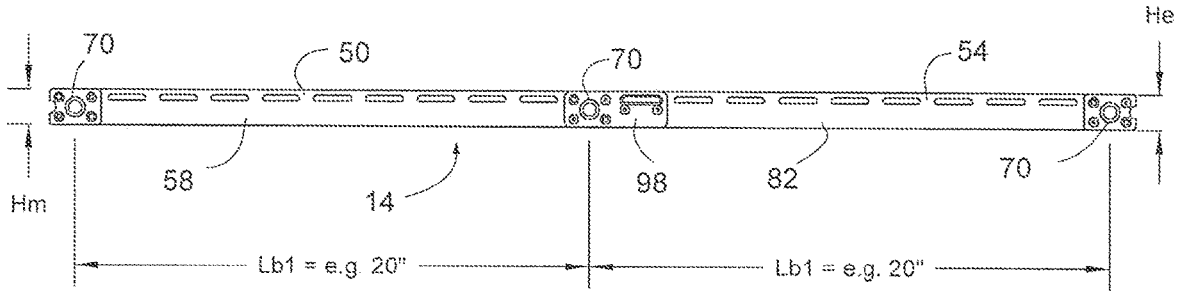
FIG. 4 is a front view of the modular bracket of FIG. 1.
Figure 5:
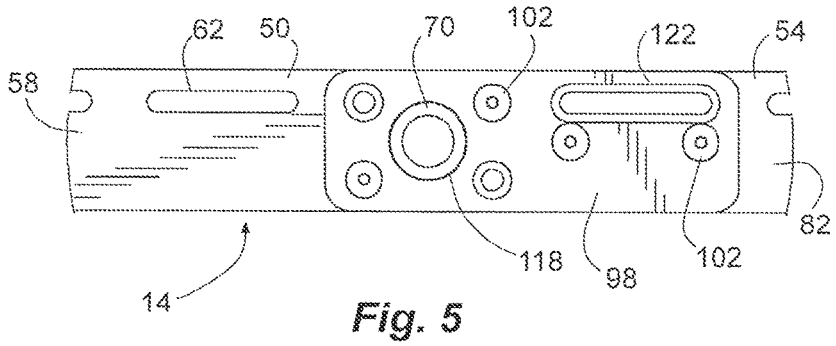
FIG. 5 is a partial detailed front view of the modular bracket of FIG. 1.

Referring to FIGS. 1-5, a modular floating shelf system 10 with a modular floating shelf bracket 14 is shown in an exemplary embodiment. Referring to FIG. 2, the system 10 can comprise a shelf 18 mounted to a wall 22. The wall 22 can have a wall panel, such as drywall, covering studs. The wall panel can have a finished surface, such as painted. The studs and the wall panel can be vertically oriented and can extend from a support surface, such as the floor, to a ceiling. The bracket 14 is mounted to and carried by the wall 22. In another aspect, the bracket 14 can also be mounted through the drywall and to the studs. In one aspect, each bracket 14 can be mounted to multiple studs. The shelf 18 is mounted to and carried by the bracket 14. The shelf 18 can have at least two bores 38 in one aspect. In another aspect, the shelf 18 can have multiple bores 38, such as at least three bores 38. The bores 38 can extend from a back of the shelf 18 and can have an opening through the back. In addition, the shelf can have an elongated pocket 42 in the back of the shelf 18. The bracket 14 can be contained in and hidden by the shelf 18 with bracket 14 received within the pocket 42 and the bores 38 of the shelf 18.

Referring again to FIGS. 1-5, the modular bracket 14 can have at least two bracket modules, such as a main bracket 50 and an extension bracket 54, that can be selectively coupled together to form the bracket 14. In one aspect, the main bracket 50 can be used alone for a narrower shelf, while both the main and the extension brackets 50 and 54 can be used for a wider shelf.

The main bracket 50 can have a main mounting plate 58 mounted to the wall 18 and contained in the pocket 42 of the shelf 18. The plate 58 can have an array of slots 62 to receive fasteners therethrough to fasten the plate 58 to the wall 22. In one aspect, the plate 58 can be formed of metal and can be formed from bar stock and stamped. The mounting plate 58 can have an outer surface 66 or front side opposite the wall 22. In addition, the mounting plate 58 can also be elongated with a width Wm greater than a height Hm, and the height Hm greater than a depth Dm. The width Wm can extend most of the width of the shelf 18; the height Hm can be tall enough to anchor to the wall 22 but short enough to be hidden by the shelf 18; and the depth Dm can be deep enough to provide strength and shallow enough to be inconspicuous and hidden in the pocket 42 of the shelf 18. Furthermore, the mounting plate 58 can have opposite lateral ends.

A pair of cantilevered main beams 70 are coupled to and extend from the main mounting plate 58 and into two of the bores 38 of the shelf 18. Each main beam 70 can be located at a different lateral end of the main mounting plate 58. The beams 70 can have a pre-determined beam-to-beam spacing zzlb1, such as 20 inches. In one aspect, the beams 70 can be formed of metal, such as tube or pipe stock. In another aspect, a proximal end 74 of the beams 70 can be threaded, and can thread into threaded bores 78 of the main mounting plate 50. In another aspect, the proximal end 74 of the beams 70 can be welded to the mounting plate 58, such as at the outer surface or rear of the plate. Various aspects of floating shelves and connecting the beams 70 to the plate 58 are described and shown in U.S. Pat. No. 9,861,198, filed Mar. 30, 2016, and U.S. Provisional Patent Application No. 63/270,723, filed Oct. 22, 2021, which are hereby incorporated herein by reference.

The extension bracket 54 is similar in many respects to the main bracket 50, but has a single beam 70 rather than a pair of beams 70. The bracket 54 has an extension mounting plate 82 mounted to the wall 22 proximate to the main mounting plate 58 and contained within the pocket 42 of the shelf 18. In addition, a seam 86 (FIG. 2) is defined between the main and extension mounting plates 58 and 82. Like the main mounting plate 58, the extension mounting plate 82 can have an array of slots 62 to receive fasteners therethrough to fasten the plate 82 to the wall 22. In one aspect, the plate 82 can be formed of metal and can be formed from bar stock and stamped. The mounting plate 82 can have an outer surface 66 or front side opposite the wall 22. In addition, the mounting plate 58 can also be elongated with a width We greater than a height He, and the height He greater than a depth De. The widths Wm and We can extend most of the width of the shelf 18. Furthermore, the mounting plate 82 can have opposite lateral ends, including a proximate end 90 proximate the main mounting plate 58 and a distal end 94 distal from the main mounting plate 58.

A cantilevered extension beam 70 is coupled to and extends from the distal end 94 of the extension mounting plate 82 and into another one of the three bores 38 of the shelf 18. Thus, while the main bracket 50 and the main mounting plate 58 can have a pair of beams 70 at opposite ends, the extension bracket 54 and the extension mounting plate 82 can have a single beam 70 at the distal end 94.

As indicated above, the main and extension brackets 50 and 54, and the main and extension mounting plates 58 and 82, can be selectively coupled together. When coupled together, the combined brackets 50 and 54, and combined mounting plates 58 and 82, can have three beams 70. The beams 70 can be equally spaced-apart from one another, and can have equal beam-to-beam spacing.

A coupler plate 98 can couple the main and extension mounting plates 58 and 82 together. The coupled plate 98 can be coupled to and carried by the proximal end 90 of the extension mounting plate 82, opposite the beam 70. In one aspect, the coupler plate 98 can be mounted to the extension mounting plate 82 with threaded fasteners 102 received through countersunk bores 106 in the coupler plate 98 and engaging threaded bores 110 in the extension mounting plate 82. Similarly, the coupler plate 98 can be selectively coupled to the main mounting plate 58 with the threaded fasteners 102 received through the countersunk bores 106 in the coupler plate 98 and engaging threaded bores 110 in the main mounting plate 58 to couple the coupler plate 98 to the main mounting plate 58.

The coupler plate 98 can have an overhang 114 extending beyond the extension mounting plate 82 and coupled to the main mounting plate 58 of the main bracket 50. In one aspect, a bore 118 can extend through the overhang 114 of the coupler plate 98. One of the pair of cantilevered main beams 70 of the main bracket 58 can be received through the bore 118 of the coupler plate 98 of the extension bracket 82. The bore 118 can facilitate alignment and coupling of the countersunk bores 106 in the coupler plate 98 with the threaded bores 110 of the main mounting plate 58.

In another aspect, the coupler plate 98 can overlap the seam 86 between the main and extension mounting plates 58 and 82 to couple to both the main and extension mounting plates 58 and 82, and thus both the main and extension brackets 50 and 54, together. The overlapping coupler plate 98 can strengthen the connection between the two brackets 50 and 54 and facilitate a linear modular bracket 14.

In another aspect, the coupler plate 98 can have at least one slot 122 aligned with at least one slot of the array of slots 62 in the extension mounting plate 82. In another aspect, the coupler plate 98 can be formed of metal and can be formed from bar stock and stamped.

In another aspect, the main and extension beams 70 together define the modular floating shelf bracket 14 with lateral beams 70*b* at lateral opposite ends and at least one intermediate 70*c* beam between the lateral beams 70*b*. Thus, the main bracket 50 alone can have a pair of beams 70, while the modular bracket 14 with the main and extension brackets 50 and 54 can have three beams 70, including the lateral beams 70*b* and the intermediate beam 70*c*. In one aspect, all the beams 70 can have the same depth, e.g. 6 inches, and the same diameter, e.g. ¾ inch.

In another aspect, face plates 126 can be coupled to opposite distal ends of the modular bracket 14. The face plates 126 can support the lateral beams 70*b*. In addition, the face plates 126 can provide the modular bracket 14 with a constant thickness on the lateral ends as at an intermediate portion with the coupler plate 98. Thus, the face plates 126 can compensate for the coupler plate 98 in an intermediate position on the bracket 14 so that the bracket 14 mates with the slot 42 in the shelf 18 without wobbling. Thus, a pair of lateral face plates 126 can each be coupled to and carried by a different one of the main and extension mounting plates 58 and 82 of the main and extension brackets 54 and 58. The pair of face plates 126 can each having a bore 118 receiving the another one of the at least two main beams 70*b* and the extension beam 70*b*, respectively. The face plates 126 can have threaded fasteners 102 received through the countersunk bores 106 in the face plates 126 and engaging threaded bores 110 in the main and extension mounting plates 58 and 82 to couple the face plates 126 to the main and extension mounting plates 58 and 82. One of the face plates 126 can be a main face plate coupled to and carried by the main mounting plate 58 of the main bracket 50; while the other of the face plates 126 can be an extension face plate coupled to and carried by the extension mounting plate 82 of the extension bracket 54.

Figure 6:
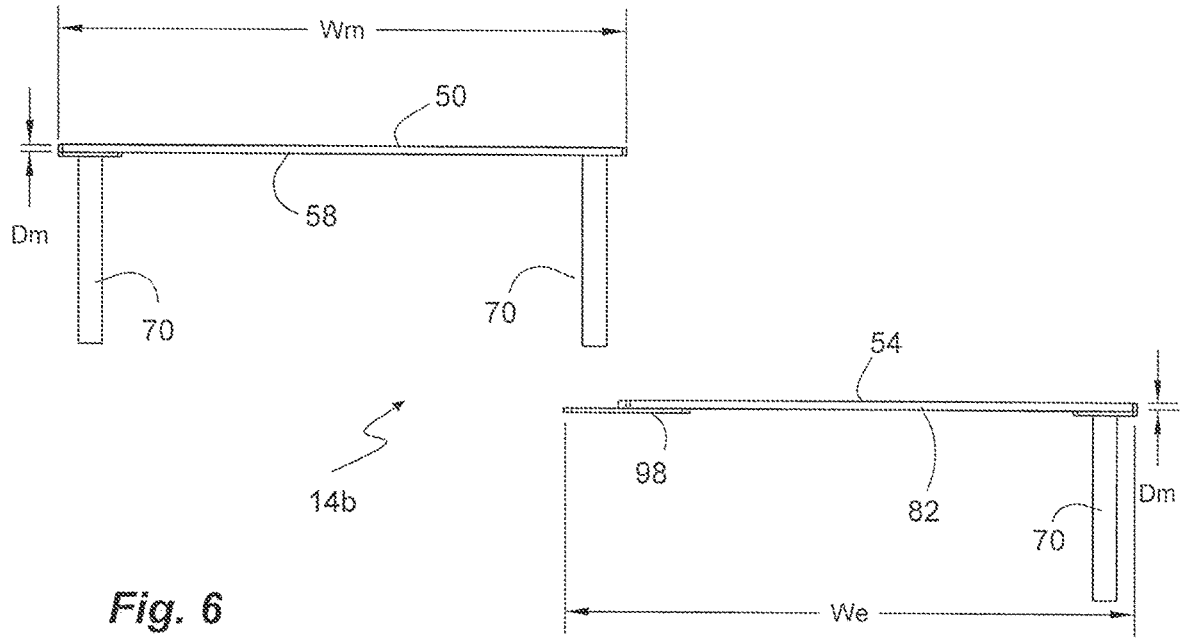
FIG. 6 is an exploded top view of another modular bracket in accordance with an embodiment of the invention, shown with a 16-inch beam-to-beam spacing.
Figure 7:
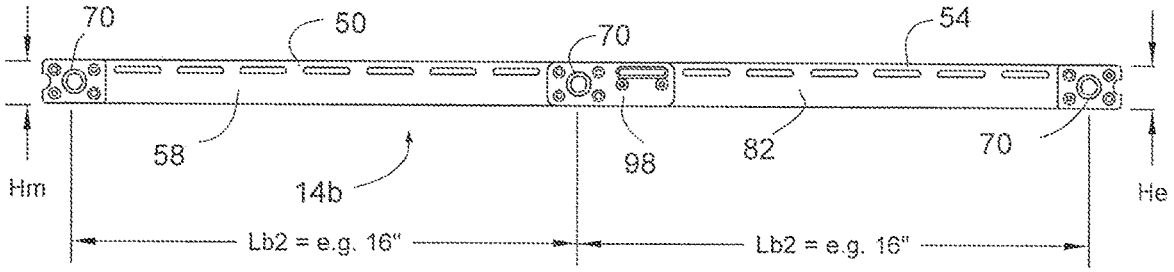
FIG. 7 is a front view of the modular bracket of FIG. 6.
Figure 8:
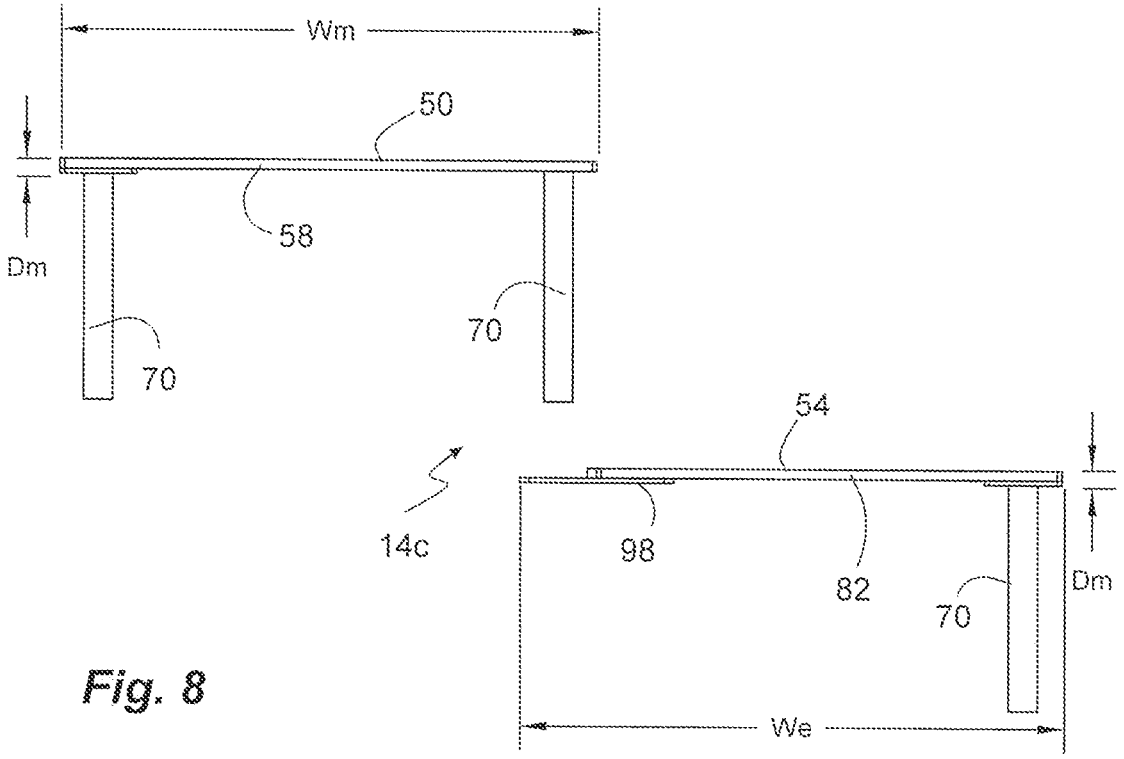
FIG. 8 is an exploded top view of another modular bracket in accordance with an embodiment of the invention, shown with a 12-inch beam-to-beam spacing.
Figure 9:
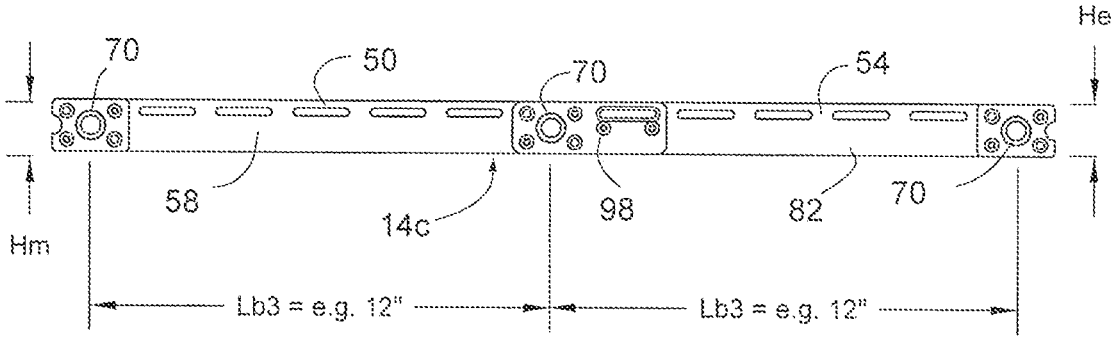
FIG. 9 is a front view of the modular bracket of FIG. 8.
Figure 10:
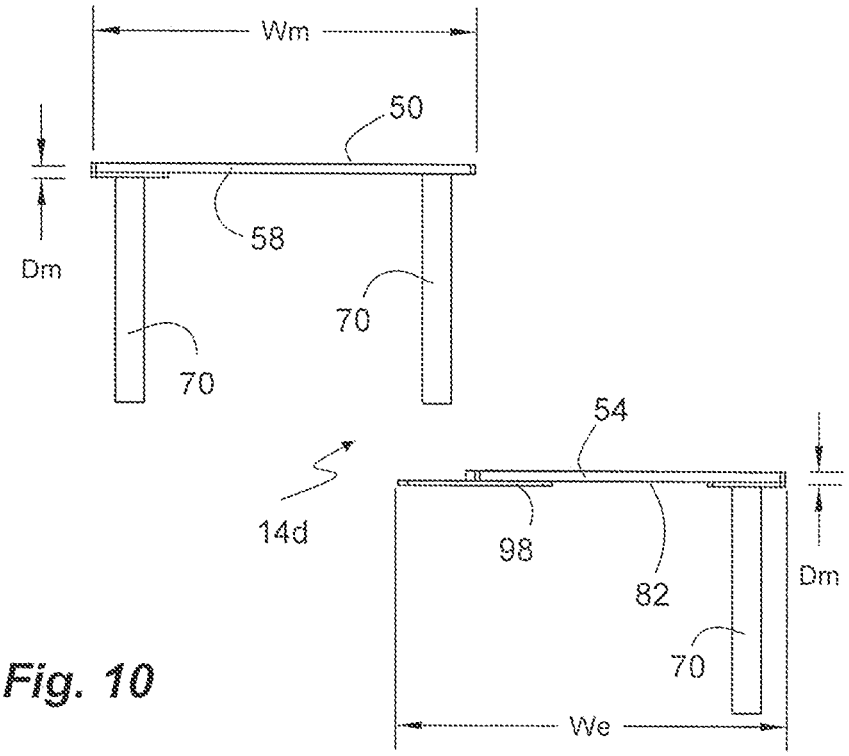
FIG. 10 is an exploded top view of another modular bracket in accordance with an embodiment of the invention, shown with an 8-inch beam-to-beam spacing.
Figure 11:
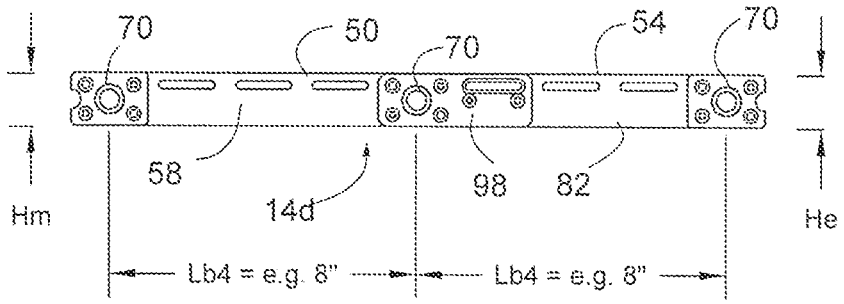
FIG. 11 is a front view of the modular bracket of FIG. 10.
Figure 12:
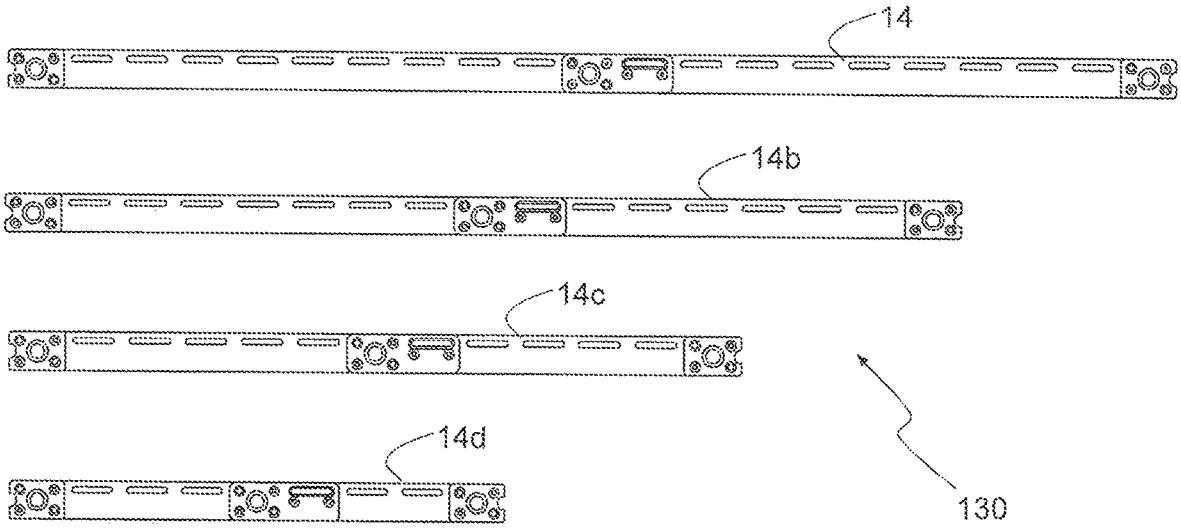
FIG. 12 is a front view of a modular floating shelf system in accordance with an embodiment of the invention, showing multiple modular bracket pairs with different beam-to-beam spacing.

Referring to FIGS. 6 and 7, another modular bracket 14*b* is shown that is similar in many respects to the modular bracket 14 described above, and which description is hereby incorporated herein by reference. The modular bracket 14*b* can have a different beam-to-beam spacing Lb2, such as 16 inches. Referring to FIGS. 8 and 9, another modular bracket 14*c* is shown that is similar in many respects to the modular brackets 14 and 14*b* described above, and which descriptions are hereby incorporated herein by reference. The modular bracket 14*c* can have a different beam-to-beam spacing Lb3, such as 12 inches. Referring to FIGS. 10 and 11, another modular bracket 14*d* is shown that is similar in many respects to the modular brackets 14-14*c* described above, and which descriptions are hereby incorporated herein by reference. The modular bracket 14*d* can have a different beam-to-beam spacing Lb4, such as 8 inches. Referring to FIG. 12, a modular bracket system 130 is shown with multiple different main and extension bracket pairs providing different beam-to-beam spacing between different pairs. The system 130 can comprise a wider main and extension bracket pair, e.g. 14, having a wider beam-to-beam spacing Lb1, e.g. 20 inches, for a wider shelf; and a narrower main and extension bracket pair, e.g. 14*d*, having a narrower beam-to-beam spacing 114, e.g. 8 inches, for a narrower shelf. In another aspect, the system 130 can further comprise at least one intermediate main and extension bracket pair, e.g. 14*b* or 14*c*, having an intermediate beam-to-beam spacing Lb2 or Lb3, e.g. 16 or 12 inches, for a shelf with an intermediate width. Thus, the system 130 can accommodate multiple different shelves with multiple different widths.

Figure 13:
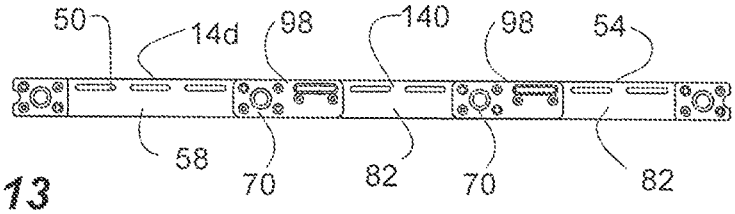
FIG. 13 is a front view of another modular shelf bracket in accordance with an embodiment of the invention, showing multiple modular brackets coupled together.
Figure 14:
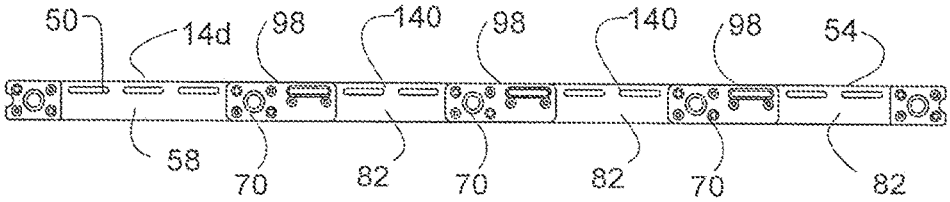
FIG. 14 is a front view of another modular shelf bracket in accordance with an embodiment of the invention, showing multiple modular brackets coupled together.
Figure 15:
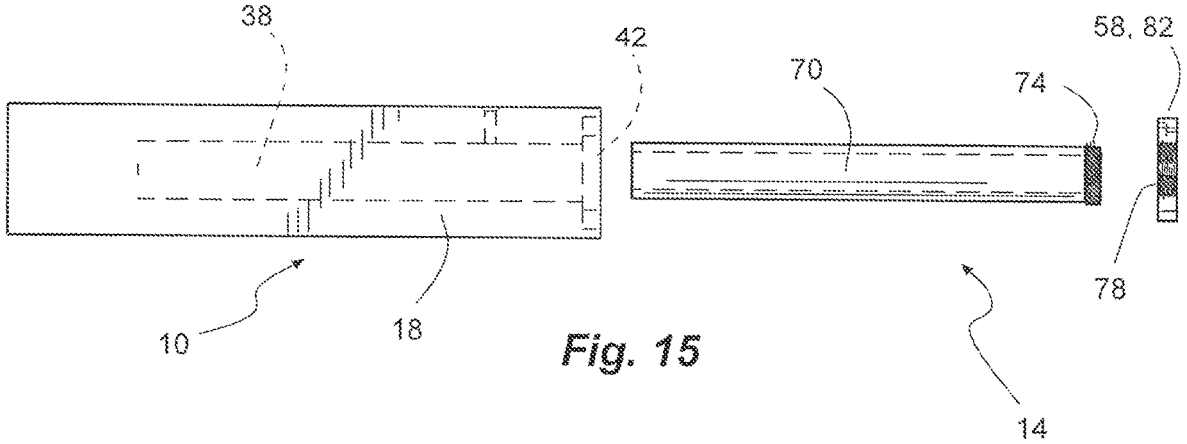
FIG. 15 is an exploded side view of the modular floating shelf bracket of FIG. 1, shown with a shelf.
Figure 16:
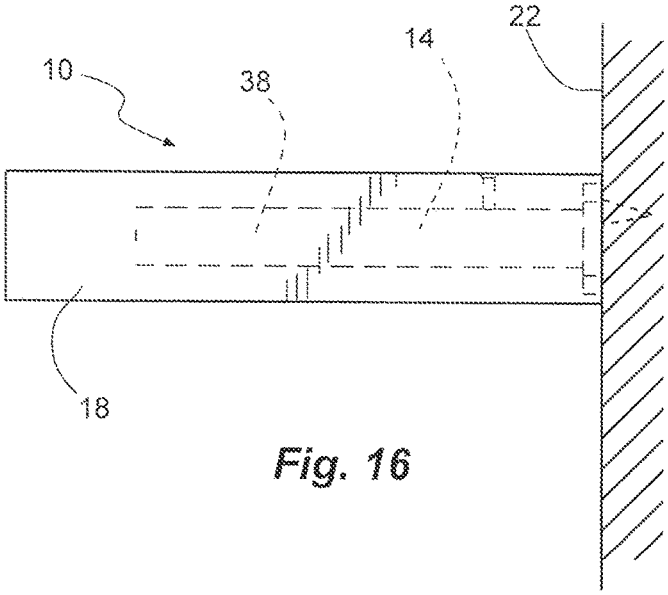
FIG. 16 is an exploded side view of the modular floating shelf system of FIG. 2.

Referring to FIGS. 13 and 14, each modular bracket, e.g. 14*d*, can comprise multiple extension brackets 54, and can have multiple beams 70 to further accommodate shelves with wider widths. In one aspect, the face plate 126 of an extension bracket 54 can be removed to form an intermediate bracket 140. The intermediate bracket 140 may comprise a mounting plate 82, a coupler plate 98, and a beam 70, but without a faceplate 126.

Various aspects of floating shelves are described and shown in U.S. Pat. No. 9,861,198, filed Mar. 30, 2016, and U.S. Provisional Patent Application No. 63/270,723, filed Oct. 22, 2021, which are hereby incorporated herein by reference.

As used in this specification and the appended claims, the singular forms "a," "an" and "the" include plural referents unless the context clearly dictates otherwise. Thus, for example, reference to "a layer" includes a plurality of such layers.

In this disclosure "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the items) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used, Occurrences of the phrase "in one embodiment," or "in one aspect," herein do not necessarily all refer to the same embodiment or aspect, As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected, Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A modular floating shelf system comprising:

a) a modular floating shelf bracket configured to be mounted to and carried by a wall;

b) a shelf mounted to and carried by the modular floating shelf bracket, and having an elongated pocket and at least three bores;

c) the modular floating shelf bracket being contained in and hidden by the shelf with the modular floating shelf bracket received within the pocket and the at least three bores of the shelf; and d) the modular floating shelf bracket comprising at least two bracket modules, including a main bracket and an extension bracket, selectively coupled together;

e) the main bracket comprising:

i) a main mounting plate configured to be mounted to the wall and contained in the pocket of the shelf, and having a width greater than a height, the height greater than a depth, and opposite lateral ends; and ii) a pair of cantilevered main beams coupled to and extending from the main mounting plate and into two of the at least three bores of the shelf, with each main beam located at a different lateral end of the main mounting plate; and f) the extension bracket comprising:

i) an extension mounting plate configured to be mounted to the wall proximate to the main mounting plate and contained within the pocket of the shelf, and defining a seam between the main and extension mounting plates, and having a width greater than a height, the height greater than a depth, and opposite lateral ends, including a proximate end proximate the main mounting plate and a distal end distal from the main mounting plate;

ii) a cantilevered extension beam coupled to and extending from the distal end of the extension mounting plate and into another one of the at least three bores of the shelf;

iii) a coupler plate coupled to the proximal end of the extension mounting plate;

iv) an overhang of the coupler plate extending beyond the extension mounting plate and coupled to the main mounting plate of the main bracket;

v) a bore extending through the overhang of the coupler plate;

vi) one of the pair of cantilevered main beams of the main bracket received through the bore of the coupler plate of the extension bracket; and vii) the coupler plate overlapping the seam between the main and extension mounting plates and coupled to both the main and extension mounting plates, and coupling both the main and extension brackets together.

2. The system in accordance with claim 1, further comprising:

a) an array of slots in the main mounting plate of the main bracket;

b) an array of slots in the extension mounting plate of the extension bracket; and c) a slot in the coupler plate aligned with at least one of the array of slots in the extension mounting plate.

3. The system in accordance with claim 1, further comprising:

a) threaded bores in the main and extension mounting plates;

b) countersunk bores in the coupler plate aligned with the threaded bores; and c) threaded fasteners received through the countersunk bores and engaging the threaded bores to couple the coupler plate to the main and extension mounting plates.

4. The system in accordance with claim 1, further comprising:

a) the main and extension beams together defining the modular floating shelf bracket with lateral beams at lateral opposite ends and at least one intermediate beam between the lateral beams;

b) a pair of lateral face plates each coupled to and carried by a different one of the main and extension plates of the main and extension brackets; and c) the pair of face plates each having a bore receiving the another one of the at least two main beams and the extension beam, respectively.

5. The system in accordance with claim 1, further comprising:

a) multiple different main and extension bracket pairs providing different beam-to-beam spacing between different pairs, including:

b) a wider main and extension bracket pair having a wider beam-to-beam spacing configured for a wider shelf; and c) a narrower main and extension bracket pair having a narrower beam-to-beam spacing configured for a narrower shelf.

6. The system in accordance with claim 5, further comprising:

an intermediate main and extension bracket pair having an intermediate beam-to-beam spacing configured for a shelf with an intermediate width.

7. A modular floating shelf system configured to mount a shelf to a wall, the system comprising:

a) a modular floating shelf bracket comprising at least two bracket modules, including a main bracket and an extension bracket, selectively coupleable together;

b) the main bracket comprising:

i) a main mounting plate configured to be mounted to the wall and having a width greater than a height, the height greater than a depth, and opposite lateral ends; and ii) a pair of cantilevered main beams coupled to and extending from the main mounting plate with each main beam located at a different lateral end of the main mounting plate; and c) the extension bracket comprising:

i) an extension mounting plate configured to be mounted to the wall proximate to the main mounting plate and defining a seam between the main and extension mounting plates, and having a width greater than a height, the height greater than a depth, and opposite lateral ends, including a proximate end proximate the main mounting plate and a distal end distal from the main mounting plate;

ii) a cantilevered extension beam coupled to and extending from the distal end of the extension mounting plate;

iii) a coupler plate coupled to the proximal end of the extension mounting plate;

iv) an overhang of the coupler plate extending beyond the extension mounting plate and coupled to the main mounting plate of the main bracket; and v) a bore extending through the overhang of the coupler plate with one of the pair of cantilevered main beams of the main bracket selectively received through the bore of the coupler plate of the extension bracket when the main and extension brackets are coupled together;

d) wherein a narrower shelf is mountable to the wall by the main bracket alone with the main bracket mounted to the wall and the narrower shelf mounted to and carried by the main bracket, and with the main bracket being contained in and hidden by the narrower shelf with the main mounting plate received within an elongated pocket of the narrower shelf and the pair of main beams received within a pair of bores of the narrower shelf; and e) wherein a wider shelf is mountable to the wall by the main and extension brackets together with the main and extension brackets coupled together and mounted to the wall and the wider shelf mounted to and carried by the main and extension brackets together, and with the main and extension brackets being contained in and hidden by the wider shelf with the main and extension mounting plates received within an elongated pocket of the wider shelf and the pair of main beams and the extension beam received within three bores of the wider shelf.

8. The system in accordance with claim 7, wherein the coupler plate further comprises:

the coupler plate overlapping the seam between the main and extension mounting plates and coupled to both the main and extension mounting plates when the main and extension brackets are coupled together.

9. The system in accordance with claim 7, further comprising:

a) an array of slots in the main mounting plate of the main bracket;

b) an array of slots in the extension mounting plate of the extension bracket; and c) a slot in the coupler plate aligned with at least one of the array of slots in the extension mounting plate.

10. The system in accordance with claim 7, further comprising:

a) threaded bores in the main and extension mounting plates;

b) countersunk bores in the coupler plate aligned with the threaded bores; and c) threaded fasteners received through the countersunk bores and engaging the threaded bores to couple the coupler plate to the main and extension mounting plates.

11. The system in accordance with claim 7, further comprising:

a) the main and extension beams together defining the modular floating shelf bracket with lateral beams at lateral opposite ends and at least one intermediate beam between the lateral beams;

b) a pair of lateral face plates each coupled to and carried by a different one of the main and extension plates of the main and extension brackets; and c) the pair of face plates each having a bore receiving the another one of the at least two main beams and the extension beam, respectively.

12. The system in accordance with claim 7, further comprising:

a) multiple different main and extension bracket pairs providing different beam-to-beam spacing between different pairs, including:

b) a wider main and extension bracket pair having a wider beam-to-beam spacing configured for a wider shelf; and c) a narrower main and extension bracket pair having a narrower beam-to-beam spacing configured for a narrower shelf.

13. The system in accordance with claim 12, further comprising:

an intermediate main and extension bracket pair having an intermediate beam-to-beam spacing configured for a shelf with an intermediate width.

14. A modular floating shelf system configured to mount a shelf to a wall, the system comprising:

a) a modular floating shelf bracket comprising at least two bracket modules, including a main bracket and an extension bracket, selectively coupleable together;

b) the main bracket comprising:

i) a main mounting plate configured to be mounted to the wall and having a width greater than a height, the height greater than a depth, and opposite lateral ends; and ii) a pair of cantilevered main beams coupled to and extending from the main mounting plate with each main beam located at a different lateral end of the main mounting plate; and c) the extension bracket comprising:

i) an extension mounting plate configured to be mounted to the wall proximate to the main mounting plate and defining a seam between the main and extension mounting plates, and having a width greater than a height, the height greater than a depth, and opposite lateral ends, including a proximate end proximate the main mounting plate and a distal end distal from the main mounting plate;

ii) a cantilevered extension beam coupled to and extending from the distal end of the extension mounting plate;

iii) a coupler plate coupled to the proximal end of the extension mounting plate;

iv) an overhang of the coupler plate extending beyond the extension mounting plate and coupled to the main mounting plate of the main bracket; and v) a bore extending through the overhang of the coupler plate with one of the pair of cantilevered main beams of the main bracket selectively received through the bore of the coupler plate of the extension bracket when the main and extension brackets are coupled together.

15. The bracket in accordance with claim 14, wherein the coupler plate further comprises:

wherein a narrower shelf is mountable to the wall by the main bracket alone with the main bracket mounted to the wall and the narrower shelf mounted to and carried by the main bracket, and with the main bracket being contained in and hidden by the narrower shelf with the main mounting plate received within an elongated pocket of the narrower shelf and the pair of main beams received within a pair of bores of the narrower shelf; and wherein a wider shelf is mountable to the wall by the main and extension brackets together with the main and extension brackets coupled together and mounted to the wall and the wider shelf mounted to and carried by the main and extension brackets together, and with the main and extension brackets being contained in and hidden by the wider shelf with the main and extension mounting plates received within an elongated pocket of the wider shelf and the pair of main beams and the extension beam received within three bores of the wider shelf.

16. The bracket in accordance with claim 14, wherein the coupler plate further comprises:

the coupler plate overlapping the seam between the main and extension mounting plates and coupled to both the main and extension mounting plates when the main and extension brackets are coupled together.

17. The system in accordance with claim 14, further comprising:

a) an array of slots in the main mounting plate of the main bracket;

b) an array of slots in the extension mounting plate of the extension bracket; and c) a slot in the coupler plate aligned with at least one of the array of slots in the extension mounting plate.

18. The system in accordance with claim 14, further comprising:

a) the main and extension beams together defining the modular floating shelf bracket with lateral beams at lateral opposite ends and at least one intermediate beam between the lateral beams;

b) a pair of lateral face plates each coupled to and carried by a different one of the main and extension plates of the main and extension brackets; and c) the pair of face plates each having a bore receiving the another one of the at least two main beams and the extension beam, respectively.

19. The system in accordance with claim 14, further comprising:

a) multiple different main and extension bracket pairs providing different beam-to-beam spacing between different pairs, including:

b) a wider main and extension bracket pair having a wider beam-to-beam spacing configured for a wider shelf, and c) a narrower main and extension bracket pair having a narrower beam-to-beam spacing configured for a narrower shelf.

20. The system in accordance with claim 19, further comprising:

an intermediate main and extension bracket pair having an intermediate beam-to-beam spacing configured for a shelf with an intermediate width.

* * * * *